US005720601A

United States Patent [19]

Tark et al.

[11] Patent Number: 5,720,601

[45] Date of Patent: Feb. 24, 1998

[54] VALVE APPARATUS OF HERMETIC TYPE COMPRESSOR

[75] Inventors: Kyoung Sig Tark; Gi Bong Kwon; Sung Oun Park, all of Changwon, Rep. of Korea

[73] Assignee: LG Electronics Inc., Rep. of Korea

[21] Appl. No.: 631,996

[22] Filed: Apr. 15, 1996

[30] Foreign Application Priority Data

Apr. 20, 1995 [KR] Rep. of Korea ..... 9353/1995
Jun. 12, 1995 [KR] Rep. of Korea ..... 13142/1995

[51] Int. Cl.[6] ..... F04B 53/10

[52] U.S. Cl. ..... 417/569; 417/566; 137/527

[58] Field of Search ..... 417/569, 902, 417/566; 137/527, 527.2

[56] References Cited

U.S. PATENT DOCUMENTS 4,723,896 2/1988 Fritchman ..... 417/571
5,178,183 1/1993 Kim ..... 137/527
5,209,260 5/1993 Baek ..... 137/527
5,328,338 7/1994 Hirano et al. ..... 417/312
5,554,016 9/1996 Sasano et al. ..... 417/569

*Primary Examiner*—Charles G. Freay
*Attorney, Agent, or Firm*—Ostrolenk, Faber, Gerb & Soffen, LLP

[57] ABSTRACT

A hermetic type compressor includes an exhaust valve installed in a reentrant groove formed in a head for opening or shutting an exhaust hole, a valve spring for elastically supporting the exhaust valve, a retainer for restricting the exhaust valve and valve spring by a constant position, and a valve fixing device for fixing the exhaust valve in a fixing part, wherein the valve spring and valve fixing device are integrally formed between the head and head cover. Thus, the structure of the device is simplified, thereby improving the productivity and saving the manufacturing cost. Also, since the exhaust valve and valve spring are strongly fixed, thereby efficiency of the compressor.

8 Claims, 6 Drawing Sheets

VALVE APPARATUS OF HERMETIC TYPE COMPRESSOR

BACKGROUND OF THE INVENTION

The present invention relates to a hermetic type compressor, and more particularly, to a hermetic type compressor which simplifies a device by integrally forming a valve spring for elastically supporting an exhaust valve through which compressed gas is exhausted, in its shut direction, and a retainer for defining the position of the valve spring constantly, and improves the closing characteristic of the exhaust valve by providing a valve fixing device for fixing the exhaust valve.

In general, numerous technical developments have been attempted for the efficiency improvement of a hermetic type compressor used in a cooling system such as a refrigerator. The development has mainly aimed at the improved motor efficiency, smooth function of various parts of the device and improved discharge system in a cylinder. Among them, specifically, the discharge system of a cylinder greatly influences on the improvement of the efficiency of the compressor, and various technical advancements in that field have been made and relevant patents have been proposed thereabout.

A valve device used in a conventional hermetic type compressor is constituted by a suction valve, a cylinder head, a packing and an exhaust valve, In view of these constituents, the device is largely divided into two types, that is, a structure that the exhaust valve is inserted into a housing part formed in a head, and the other structure that the other elements are sequentially assembled on the upper surface of the head.

Of the two types, the mainly used type is that the exhaust valve is inserted into a reentrant groove of the head, which will now be explained inclusive of well-known U.S. Patents.

A conventional valve device used in a hermetic type compressor disclosed in the U.S. Pat. No. 4,723,896 includes a housing part 2 for housing a exhaust valve device in a head 1. The housing part 2 is provided with an exhaust hole 3. An exhaust valve 4 for covering the exhaust hole 3 is disposed above the exhaust hole 3. A valve spring 5 for returning the exhaust valve 4 from the opened state to the covered state is positioned above the exhaust valve 4. A retainer 6 for restricting the valve spring 5 not to be deviated exceeding a constant position is fixed in the housing part 2 of the head 1. The above-mentioned elements are fixed by a clamp 7 installed above the retainer 6. These components are disposed between a head cover 8 and a cylinder 9. Also, the head cover 8 and cylinder head 1 are provided with a packing 10 for preventing the leakage of high-temperature and high-pressure refrigerant, the packing 10 being compactly installed therebetween. Undefined reference numeral **9*a*** is a piston.

The U.S. Pat. No. 5,209,260 discloses that a housing part 12 having a first acceptance unit **12*a* and a second acceptance unit 12*b* formed stepwise is formed in a head 11. An exhaust valve 14 and a valve spring 15 are installed in the first acceptance unit 12*a* in which the housing part 12 is formed more below than the second acceptance unit 12*b*. A retainer 16 is fixedly installed in the second acceptance unit 12*b*. In such an exhaust valve system, since the retainer 16 buried in the second acceptance unit 12*b* is strongly fixed in the head 11, a clamp shown in the U.S. Pat. No. 4,723,896 is not necessitated. Undefined reference numerals 13 and 18** are an exhaust hole and a head cover, respectively.

The U.S. Pat. No. 5,328,338 discloses a structure that only an exhaust valve 24 and valve spring 25 are installed without a retainer shown in the U.S. Pat. No. 5,209,260, in which a protrusion **28*a* is formed in a head cover 28 to fix the valve spring 25. Undefined reference numerals 23 and 30** are an exhaust hole and a packing, respectively.

The operation of the conventional hermetic type compressor is performed in the same way as that of a general compressor. If power is applied, a rotator is rotated by the electromagnetic operation of a stator and the rotator, and a crank shaft is rotated by the rotation of the rotator. The vertical rotary power of the crank shaft is converted into the horizontal movement by a connecting rod and a slider so that a piston reciprocally moves within the cylinder. When a piston (not shown) proceeds, the refrigerant is led inside a cylinder through a suction hole and a suction valve of the cylinder head. The thus-incoming refrigerant is compressed by the forward operation of the piston and then is exhausted through the exhaust hole of the cylinder head while opening the exhaust valve.

At this time, in the thus-operated conventional valve devices, a housing part is formed in the head and the exhaust valve is inserted into the housing part. When the compressed high temperature and high-pressure refrigerant is exhausted through the exhaust hole, the length of the exhaust hole is determined by the thickness of the head. Then, since the space corresponding to the diameter and length of the exhaust hole is exposed to the cylinder, the compressed refrigerant partially remains in a dead volume after the exhaust valve is shut. While the piston retrocedes from the cylinder to open the exhaust valve, the compressed refrigerant remaining in the dead volume is re-expanded, which impedes the normal intake of the refrigerant. To overcome such a problem, it is necessary to make the thickness of the head thin to reduce the length of the exhaust hole, thereby increase the efficiency of the compressor.

However, among the conventional arts, the U.S. Pat. No. 4,723,896 discloses that the valve device includes various components such as the exhaust valve 4, valve spring 5 and retainer 6, the device becomes complex. Also, since a separate fixed groove for inserting the clamp 7 should be formed in the head 1, the operational efficiency is lowered.

Also, in the valve device used in the hermetic type compressor according to the U.S. Pat. No. 5,209,260, although the clamp 7 is not necessitated, the structural complexity due to the fixed retainer 16 cannot be solved. Also, since the retainer 16 is fixed in the head 11, the central portion thereof is reversed. Thus, if the valve spring 15 is elevated by the exhaust valve 14 to then be deformed, the valve spring 15 stops in a state where it deviates from a predetermined position, so that the opening timing of the exhaust valve 14 of the compressed refrigerant and re-expansion loss, thereby lowering the efficiency of the compressor.

Also, in the U.S. Pat. No. 5,328,338, since a protrusion **28*a* is formed in the head cover 28 and the valve spring 25 is fixed by using a tongue-shaped packing 27, it is difficult to fabricate the parts. Also, the valve spring 25** cannot be fixed efficiently.

Although it is not shown, in the valve device disclosed in the U.S. Pat. No. 5,178,183, the components are simplified with the exhaust valve and valve spring, the valve spring also functioning as a retainer, which is not enough for the valve spring to fix the exhaust valve.

SUMMARY OF THE INVENTION

Therefore, it is an object of the present invention to provide a hermetic type compressor which can simplify the structure of a valve device by integrally forming a valve spring and a retainer on a single valve plate.

It is another object of the present invention to provide a hermetic type compressor which can improve the performance of the compressor by exactly controlling the opening range and timing of an exhaust valve by strongly fixing the exhaust valve using a separate exhaust valve fixing member.

To accomplish the above objects, there is provided a hermetic type compressor according to the present invention comprising: an exhaust valve installed in a reentrant groove formed in a head for opening or shutting an exhaust hole; a valve spring for elastically supporting the exhaust valve; a retainer for restricting the exhaust valve and valve spring by a constant position; and a valve fixing device for fixing the exhaust valve in a fixing part, wherein the valve spring and valve fixing device are integrally formed between the head and head cover.

The integrally formed valve spring and valve fixing device are fixed in a valve plate.

The integrally formed valve spring and valve fixing device are fixedly inserted into a fixed protrusion formed in the head.

Also, according to another aspect of the present invention, there is provided a hermetic type compressor comprising: an exhaust valve installed in a reentrant groove formed in a head for opening or shutting an exhaust hole; a valve spring for elastically supporting the exhaust valve; and a retainer for restricting the exhaust valve and valve spring by a constant position, wherein the valve spring and valve fixing device are integrally formed between the head and head cover.

The integrally formed valve spring and valve fixing device are fixed in a valve plate.

A valve fixing device is installed in the opposite to the integrally formed valve spring and valve fixing device.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
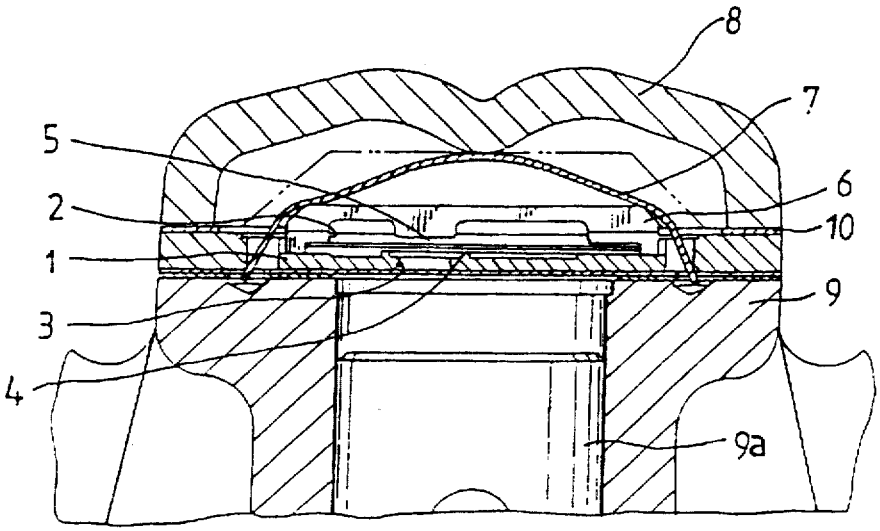
FIG. 1 CONVENTIONAL ART
FIG. 1 is a cross-sectional view of a conventional valve device used in a hermetic type compressor disclosed in the U.S. Pat. No. 4,723,896.
Figure 2:
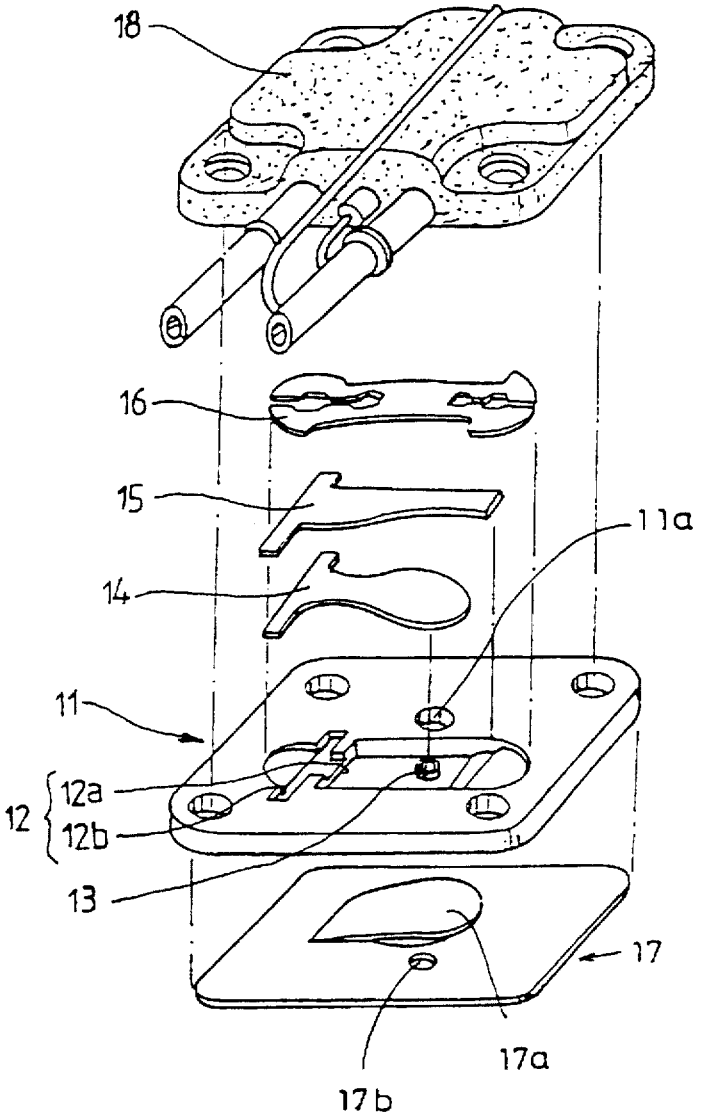
FIG. 2 CONVENTIONAL ART
FIG. 2 is an exploded perspective view of a conventional valve device used in a hermetic type compressor disclosed in the U.S. Pat. No. 5,209,260.
Figure 3:
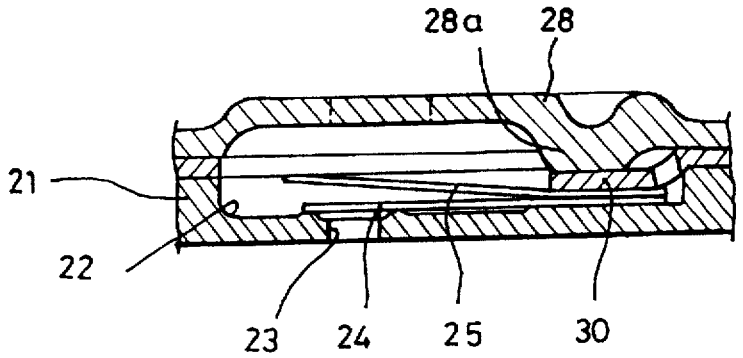
FIG. 3 CONVENTIONAL ART
FIG. 3 is a cross-sectional view of a conventional valve device used in a hermetic type compressor disclosed in the U.S. Pat. No. 5,328,338.
Figure 4:
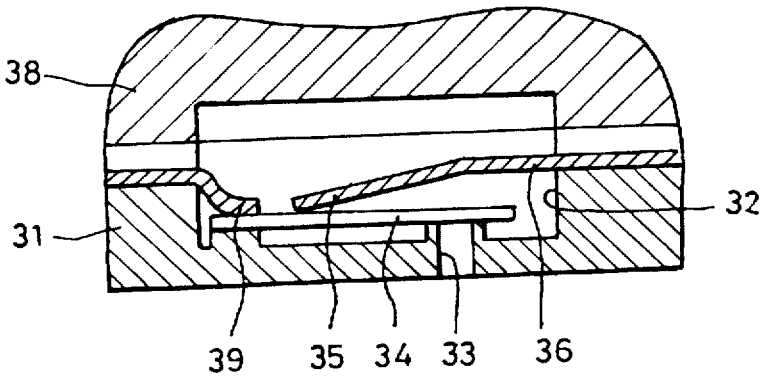
FIG. 4 is a cross-sectional view of a valve device used in a hermetic type compressor according to the present invention.
Figure 5:
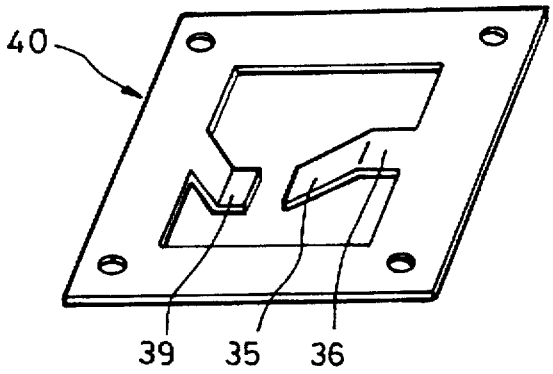
FIG. 5 is a perspective view showing a valve plate shown in FIG. 4.

In a valve device for a hermetic type compressor according to the present invention, there is provided in a head 31 a housing part 32 having an exhaust hole 33. An exhaust valve 34 for opening or shutting the exhaust hole 33 is installed inside the housing part 32. A valve spring 35 for elastically supporting the exhaust valve 34 in a direction of shutting the exhaust valve 34 is provided.

A head cover 38 for covering various components described above is coupled to the head 31.

The valve spring 35 and the retainer 36 are formed in one valve plate 40 installed in the housing part 32.

Also, a valve fixing device 39 for fixedly supporting one end of the exhaust valve 34 is separately formed in the valve plate 40 to strongly fix the exhaust valve 34, thereby improving the shutting characteristic of the exhaust valve 34.

The operation of the valve device according to the present invention having the aforementioned configuration will now be described. When a piston (not shown) retrocedes in the cylinder, the suction valve is opened through an suction hole of the head. Then, if the refrigerant is led inside compressed space of the cylinder, the refrigerant is compressed by the piston reciprocating by the rotation power of a crank shaft. Then, while the piston proceeds again to open the exhaust valve 34 through the exhaust hole 33 of the head 31 to then discharge the refrigerant. At this time, the exhaust valve 34 is opened in a state where one end of the exhaust valve 34 is fixed by the valve fixing device 39 and the exhaust hole 33 is again shut by the elastic force of the valve spring 35.

Here, the retainer 36 integrally formed with the valve spring 35 operates by the valve spring 35. The compressed refrigerant passing through the exhaust valve 34 passes through a discharge frame by an exhaust force to then be exhausted to the outside of the compressor via a discharge pipe.

Accordingly, in the hermetic type compressor according to the present invention, the valve plate 40 in which the valve spring 35 and retainer 36 are integrally formed is installed between the head 31 and the head cover 38, thereby simplifying the structure, improving the productivity and saving the manufacturing cost.

Figure 6:
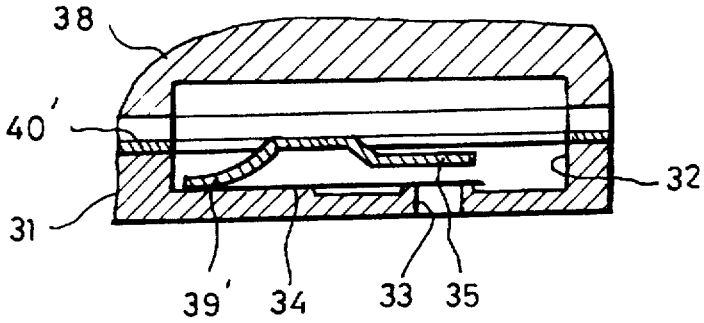
FIG. 6 is a cross-sectional view showing a modified example of the present invention.
Figure 7:
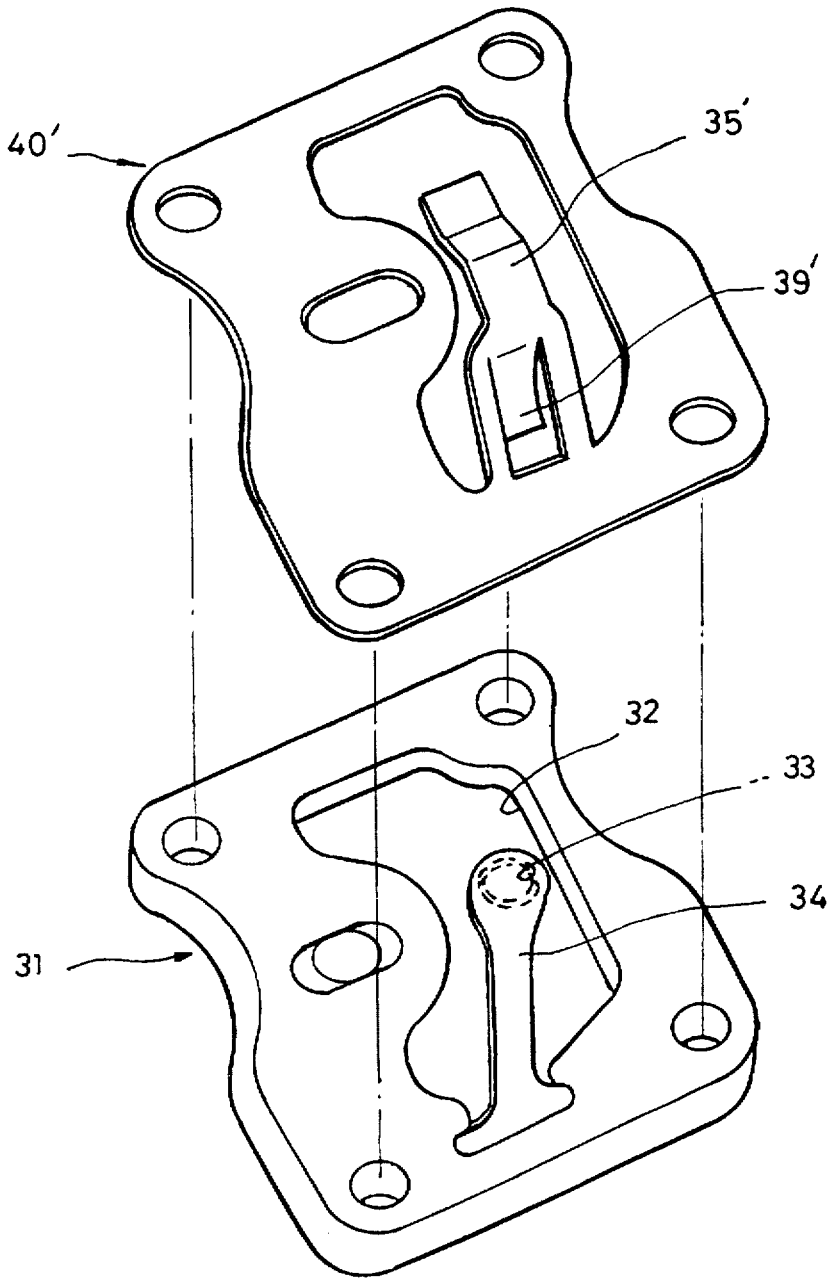
FIG. 7 is a perspective view showing a valve plate shown in FIG. 6.

Also, as modified example, as shown in FIGS. 6 and 7, a structure that a valve fixing device 39' and a valve spring 35' is attainable, by which the structure of a valve plate 40' is simpler, thereby saving the manufacturing cost.

Figure 8:
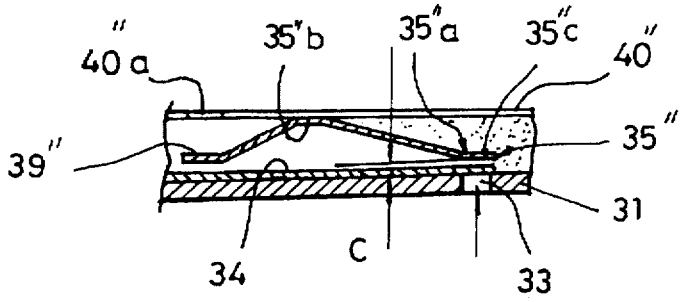
FIG. 8 is a perspective view showing another modified example of the present invention.
Figure 9:
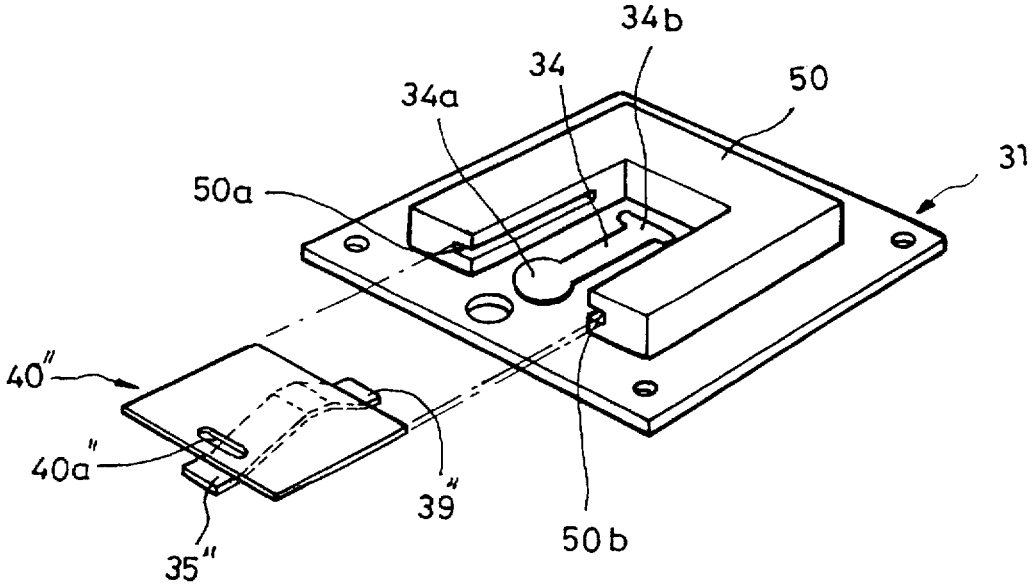
FIG. 9 is a cross-sectional view showing a connection state of FIG. 8.

Also, as another modified example, as shown in FIGS. 8 and 9, in order to make it easy to fix the valve plate 40 or 40', it is possible to embody a modified example in which a fixed protrusion 50 embracing the exhaust valve 34 is formed on the cylinder head 31.

A fixed grooves 50*a* and 50*b* into which the valve plate 40' is fixedly inserted is formed in opposed inner sides of the fixed protrusion 50.

The valve plate 40" is inserted into the fixed grooves 50*a* and 50*b* of the fixed groove 50, an exhaust groove 40"*a* through which high-pressure gas exhausted via the exhaust hole 33 is formed in one side of the upper surface thereof. A valve fixing device 39" for fixing the exhaust valve 34 is formed in one side of the lower surface of the valve plate 40", and a valve spring 35" for restricting the opening timing and range of the exhaust valve 34 is installed in the other side thereof.

The valve spring 35" is formed in a slop of a predetermined angle toward a flexible end 35"*a* from a fixed end 35"*b* fixed in the lower surface of the valve plate 40". In the tip of the flexible end 35"*a*, there is provided a peripheral flattening part 35"*c* for maintaining a predetermined distance C from the exhaust valve 34.

In the modified example of the exhaust valve device of the hermetic type compressor according to the present invention, the cylinder head 31 is housed in a suction valve plate (not shown) installed in one side of a cylinder (not shown), the exhaust valve 34 is inwardly housed in the fixed protrusion 50 to cover the exhaust hole 33, and then the valve plate 40" is inserted into the fixed grooves 50*a* and 50*b* of the fixed protrusion 50. A packing is inserted between the cylinder head 31 and the head cover 38 to then be screw-locked for assembly.

In the-thus assembled exhaust valve device of the hermetic type compressor, the high-pressure gas compressed in the cylinder by a compression stroke pushes the exhaust valve 34 to then be discharged. As the compression stroke continuously proceeds, the exhaust valve 34 is kept open. Then, if the exhaust valve 34 is elevated exceeding the distance C formed between the exhaust valve 34 and valve spring 35", the valve spring 35" is also elevated along with the exhaust valve 34. If the compression stroke is completed to start a suction stroke, the valve spring 35" having been elevated during the discharge operation restores to the original position to push the exhaust valve 34, thereby shutting the exhaust valve 34 exactly. In this manner, the exhaust valve 34 is surely fixed by the valve fixing device 39" fixed in one side of the valve plate 40" and a constant distance is maintained from the exhaust valve 34 by the valve spring 35" having a peripheral flattening part 25"*c* in the flexible end 35"*a* strongly fixed in the other side thereof with a slope of a predetermined angle, thereby making the exhaust valve 34 open or shut smoothly.

As described above in detail, the hermetic type compressor according to the present invention, the exhaust valve 34 is exactly fixed by the valve fixing device 39' provided in the valve plate 40" and a predetermined distance from the exhaust valve 34 is attained by the valve spring 35" strongly fixed in the lower surface of the valve plate 40", thereby controlling the opening or shutting of the exhaust valve 34. Thus, an excessive compression loss due to delay in opening time of the exhaust valve 34 or a counter-flow of the high-pressure gas inside the cylinder due to delay in shutting time thereof is prevented, which improves the performance of the compressor. Also, since a shock generated during the opening or shutting of the exhaust valve 34 is prevented by the valve spring 35', vibration or noise is reduced.

What is claimed is:

1. A valve apparatus of a hermetic type compressor comprising:

an exhaust valve installed in a housing part formed in a head for opening or shutting an exhaust hole;

a valve spring for elastically supporting said exhaust valve;

a retainer for restricting said exhaust valve and valve spring by a constant position; and a valve fixing device for fixing said exhaust valve, wherein said valve spring and valve fixing device are constructed as a single unit located between said head and a head cover.

2. A valve apparatus of a hermetic type compressor as claimed in claim 1, wherein said valve spring and valve fixing device are fixed in a valve plate.

3. A valve apparatus of a hermetic type compressor as claimed in claim 1, wherein said valve spring and valve fixing device are fixedly inserted into a fixed protrusion formed in said head.

4. A valve apparatus of a hermetic type compressor as claimed in claim 2, wherein said valve spring and valve fixing device are fixedly inserted into a fixed protrusion formed in said head.

5. A valve apparatus of a hermetic type compressor comprising:

an exhaust valve installed in a housing part formed in a head for opening or shutting an exhaust hole;

a valve spring for elastically supporting said exhaust valve;

a retainer for restricting said exhaust valve and valve spring by a constant position; and a valve fixing device for fixing said exhaust valve, wherein said valve spring and said retainer are constructed as a plate located between said head and a head cover.

6. A valve apparatus of a hermetic type compressor as claimed in claim 5, wherein said valve spring and retainer are fixed in a valve plate.

7. A valve apparatus of a hermetic type compressor as claimed in claim 5, wherein said valve fixing device is installed in the opposite side to said valve spring and said retainer.

8. A valve apparatus of a hermetic type compressor as claimed in claim 6, wherein said valve fixing device is installed in the opposite side to said valve spring and said retainer.

* * * * *